US005339070A

United States Patent [19]

Yalowitz et al.

[11] Patent Number: 5,339,070

[45] Date of Patent: Aug. 16, 1994

[54] COMBINED UV/IR FLAME DETECTION SYSTEM

[75] Inventors: Jeffrey S. Yalowitz, Huntsville; James M. Morrison, Meridianville; Hilary E. Roberts, Huntsville, all of Ala.

[73] Assignee: SRS Technologies, Huntsville, Ala.

[21] Appl. No.: 915,617

[22] Filed: Jul. 21, 1992

[51] Int. Cl.[5] ..... G08B 17/12

[52] U.S. Cl. ..... 340/578; 250/339.01; 250/340; 250/372; 250/554

[58] Field of Search ..... 340/578; 250/554, 339, 250/340, 372

[56] References Cited

U.S. PATENT DOCUMENTS

| | | | |
|---|---|---|---|
| 3,665,440 | 5/1972 | McMenamin | 340/578 |
| 3,825,754 | 7/1974 | Cinzori et al. | 340/578 |
| 4,101,767 | 7/1978 | Lennington et al. | 250/339 |
| 4,280,058 | 7/1981 | Tar | 250/554 |
| 4,455,487 | 6/1984 | Wendt | 340/578 |
| 4,533,834 | 8/1985 | McCormack | 340/578 |
| 4,866,420 | 9/1989 | Meyer, Jr. | 250/340 |

*Primary Examiner*—Glen R. Swann, III

*Attorney, Agent, or Firm*—John C. Garvin, Jr.; James E. Staudt

[57] ABSTRACT

A flame detector unit contains a silicon photodiode that is sensitive to UV light waves and two lead selenide photoresistors that are sensitive to IR light waves. The electromagnetic bandwidth of each sensor element is restricted by an optical wave filter to pass photons of certain wavelengths characteristic of hydrocarbon flames and to discriminate against photons of other wavelengths. Signals generated by the IR sensors are in the form of variations in electrical resistance of the sensor elements, which together with a resistor network comprise a bridge circuit which combines the two IR signals so as to discriminate against blackbody radiation sources and provide a signal which is fed through an amplifier. Amplified UV and IR signals are fed to a common analog to digital converter (ADC). Output from the ADC is fed to a digital processor through a notch filter, a cluster of weighted-moving-average filters, and into a threshold comparator/tester. Output from the comparator/tester is fed to a correlator, then through a series of alarm decision making circuits and finally into a series of alarm activation circuits. Stored wave forms relating to profiles of fire characteristics may be fed to the circuit correlator from an outside source. Data from predetermined external measurements may be fed to the alarm decision making circuits.

13 Claims, 3 Drawing Sheets

COMBINED UV/IR FLAME DETECTION SYSTEM

BACKGROUND OF THE INVENTION

1. Field of the Invention

This invention relates to the field of ultraviolet (UV) flame detectors, infrared (IR) flame detectors, and combination UV/IR flame detectors.

2. Description of the Prior Art

UV/IR detectors for flame detection until this invention utilized photoemissive-cathode electron tubes, such as Geiger-Meuller tubes, in avalanche mode to sense UV radiation from flames.

Concurrent sensing of IR radiation from the flames is performed by UV/IR detectors to confirm presence of flames in the case of hydrocarbon combustion. The utility of existing flame detector devices is limited because of performance factors inherent in the prior art, including the following factors:

The avalanche-mode UV detectors used in flame detectors tend to saturate at moderate levels of input radiation to the extent that they cannot measure accurately the characteristics of radiation from flames in the presence of strong interfering radiation. In order to reduce undesired responses of the avalanche-mode UV detectors to indirect solar radiation, existing flame detectors have utilized photocathodes with spectral sensitivity at wavelengths shorter than 260 nanometers, thus eliminating the capability to sense a major UV spectral emission line associated with hydrogen-oxygen combustion at approximately 305 nanometers wavelength. Predicted future deterioration of the earth's ozone layer, which now prevents short-wave UV solar radiation from interfering with flame detectors, may further reduce the range of flame intensities over which existing detector types are effective in flame detection.

The electronic signal processing capabilities of existing UV/IR type flame detectors are limited. Because avalanche-mode sensor devices produce nearly uniform pulses in response to inputs which may vary widely in intensity, the signal processing elements do not and cannot make use of small variations within the UV radiation intensity profiles of flames and extraneous light sources. Thus, certain significant temporal features of radiation intensity from different sources cannot be used, with products of the prior art, in performance of automatic false-alarm rejection functions.

This invention provides significant improvements in flame detection performance in comparison with existing detection devices which employ IR detectors alone, UV detectors alone, or UV/IR detector combinations with avalanche-mode UV devices. Certain of these improvements in performance arise from greater differences between measurable effects of flames and those of other phenomena i.e., background noise and energy from false alarm sources, that can be achieved by the non-saturating-mode detectors and signal processing circuits of this invention. These greater differences between measurable effects of flames and those of other phenomena achieved by this invention can be exploited to produce increased detection range, detection of smaller flames, reduction of false alarm probability, increased speed of detection response, and combinations of these enhancements. The degree of each of these enhancements is determined in relationship to the others in the embodiments of this invention by selection of appropriate signal processing summation intervals, integration intervals, weighting of sample averages, and threshold parameters.

This invention also provides significant improvements in mechanical and electrical characteristics for use in hazardous environments, when compared to existing flame detector devices that employ high-voltage avalanche-mode detectors. This invention requires only low voltage power supply and only minimal electrical charge storage. Thus the invention provides intrinsic safety in hazardous environments where potentially explosive gases, liquids, or dust are present. These safety characteristics eliminate the need for explosion-proof housings and protection of detector lense/apertures that are common in existing flame detector devices. This invention may thus be manufactured at lower cost and in smaller package size than flame detector devices which require explosion-proof packaging.

Examples of related prior art are found in the following U.S. Pat. Nos. 2,507,359 to P. Weisz; 3,122,638 to D. F. Steele et al; 3,188,593 to A. W. Vasel et al; 3,665,440 to J. M. McMenamin; 3,716,717 to A. Scheidweiler et al; and 4,769,775 to M. Kern et al.

SUMMARY OF THE INVENTION

This invention combines a non-saturating UV sensor with optical filtering and signal processing circuits to form a system that achieves a greatly improved capability for flame detection by measuring and processing intensity variation details of significant UV radiation samples, thus producing fast response and reliable detection of many types of flames. By addition of an IR sensor assembly which measures and processes intensity variation details of significant IR radiation samples, and by addition of electronic circuits to make decisions based jointly on UV and IR measurements, this invention achieves enhanced false alarm rejection capability with regard to fires which result from combustion of hydrocarbon materials.

It is therefore an objective of this invention to overcome limitations of the existing art by use of a unique system to collect significant radiation samples from false alarm sources and to analyze the radiation samples in a manner whereby details of the variations of intensity and spectral content of radiation are preserved and utilized for fast response, automatic fire alarm decision-making. False alarm radiations can have intensities similar to those of threatening flames and can overlap the flame radiations in time. The invention resolves this problem with greatly improved performance, particularly in its capability to distinguish between actual flame radiation and false alarm radiation. The performance of this invention is therefore superior when compared to all known prior art flame detectors.

These and other objects of the invention will be apparent to one skilled in the art from the following detailed description of a specific embodiment thereof.

DESCRIPTION OF PREFERRED EMBODIMENT

Figure 1:
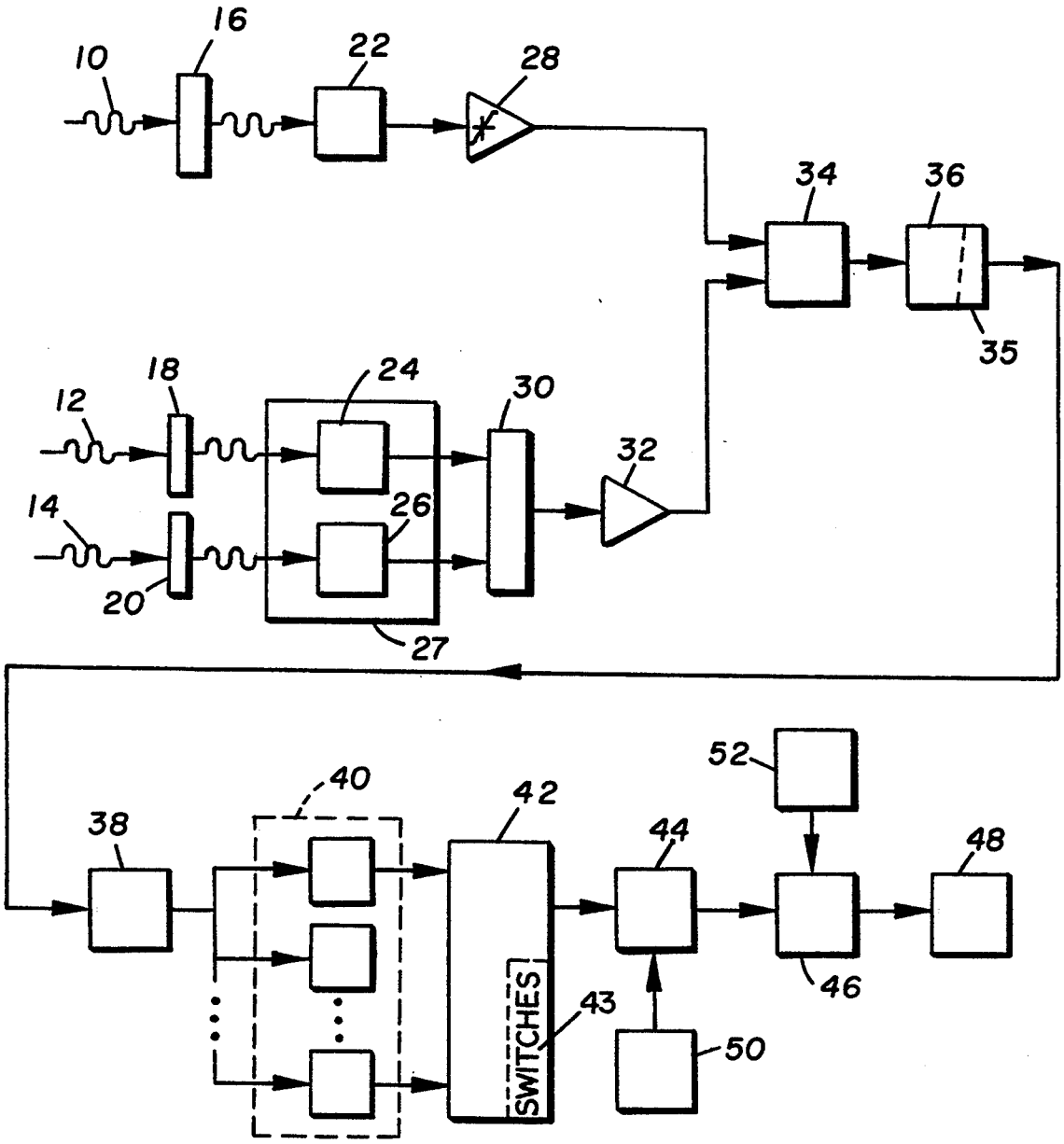
FIG. 1 is a functional block diagram of a flame detector according to a preferred embodiment of the invention.

The detector unit contains three optical sensor elements: a silicon photodiode that is sensitive to UV lightwaves and two lead selenite (PbSe) photoresistors that are sensitive to IR lightwaves. The electromagnetic bandwidth of each sensor element is restricted by an optical wave filter to pass photons of certain wavelengths characteristic of hydrocarbon flames and to discriminate against photons of other wavelengths. In embodiments for long-range flame detection, the invention is provided with a lens of fused silica or other UV transmitting material where required to increase UV optical wave capture area. Lenses of sapphire or other IR-transmitting material are provided where required to increase IR optical-wave capture area.

The UV wavelengths for which sensitivity is required are those in the approximate range of 250 nanometers (nm) to 310 nm where spectral emission lines occur from the combustion processes in hydrocarbon fires, and in other fires involving hydrogen. These spectral emission lines are believed to be associated with quantum energy releases from hydroxyl (OH) radicals produced in combustion or present in atmospheric water vapor in the vicinity of a flame.

Rejection of wavelengths longer than 330 nm is required to prevent sunlight from interfering with detection of flame emission spectra. High-altitude atmospheric gases, primarily ozone, attenuate solar UV radiation at wavelengths shorter than 330 nm sufficiently to prevent interference with detection of flame energy at 310 nm and shorter wavelengths.

The IR wavelengths for which sensitivity is required fall into two categories, the first of which is in the range between 4.3 microns and 4.5 microns where spectral emission lines occur from the combustion processes in hydrocarbon fires, and in other fires involving carbon. These spectral emission lines are believed to be associated with quantum energy releases from carbon dioxide (CO2) molecules produced in combustion or pre as atmospheric gas in the vicinity of the flame. The second category of IR wavelength is relatively close to the first, but far enough removed so as to not respond to carbon dioxide emissions. The second IR sensor operates at wavelengths between 3.3 microns and 3.5 microns. The purpose of the first IR sensor operating between 4.3 microns and 4.5 microns is to detect carbon dioxide emissions, but it is expected to be sensitive also to blackbody radiation from non-combustion objects within its field of view. Blackbody radiation is indicative of a hot surface but not necessarily of flame, so it is considered a false-alarm source in flame detectors. The purpose of the second IR sensor is to sense the blackbody radiation in similar fashion, so that the blackbody radiation components can be subtracted from the measurements made by the first sensor. The IR sensors and the filters, mounted on a thermoelectric cooler are available in a single package which is marketed by Graseby Infrared under part number 1610065.

The wave filters incorporated in the detector may be absorptive or interference filters.

The UV sensor incorporated in the present invention is hybrid integrated circuit device available from EG&G as model number HUB-2000B. This device also includes the photodiode and an operational amplifier in the same package, with a fused silica window. The circuit design employs this operational amplifier as a high-gain amplifier to provide an output that increases with increased photodiode photocurrent. A nonlinear feedback network added to the electronic circuit effectively reduces the gain when intense light levels are encountered, to prevent saturation of the amplifier. Various types of well known nonlinear feedback networks may be utilized to reduce the gain caused by intense light levels. One such network employs a high-gain feedback resistor in parallel with the series combination of a low-gain feedback resistor and a MOSFET whose gate and drain are strapped together. When high light levels are encountered by this network, the MOSFET conducts (source-drain) and lowers the effective feedback resistance, reducing amplifier gain. Other well known networks, utilizing either logarithmic nonlinearities or step nonlinearities may also be used. The nonlinear feedback networks need not follow one particular response curve to achieve the desired effect, so long as they act to reduce the amplifier gain when intense light levels are encountered.

Examples of nonlinear feedback networks and nonlinear amplifiers may be found in electronic reference manuals such as "Modern Electronic Circuit Reference Manual", by John Marks and published in 1980 by McGraw-Hill, Inc.

Unwanted visible light is filtered using a solar blind filter that passes only wavelengths of light between 225 nm and 350 nm. This filter is available from the Corion Corporation as Model number SB-300.

The present invention is based on the above mentioned findings. Now, the flame detector which is the subject of the present invention is described in more detail with reference to the drawings.

As shown in FIG. 1, rays 10, 12 and 14 of incident light are directed through optical wave filters 16, 18 and 20 respectively.

A more specific description of the optical wave filters as well as other components illustrated in FIG. 1 will be provided later in this specification.

Figure 2:
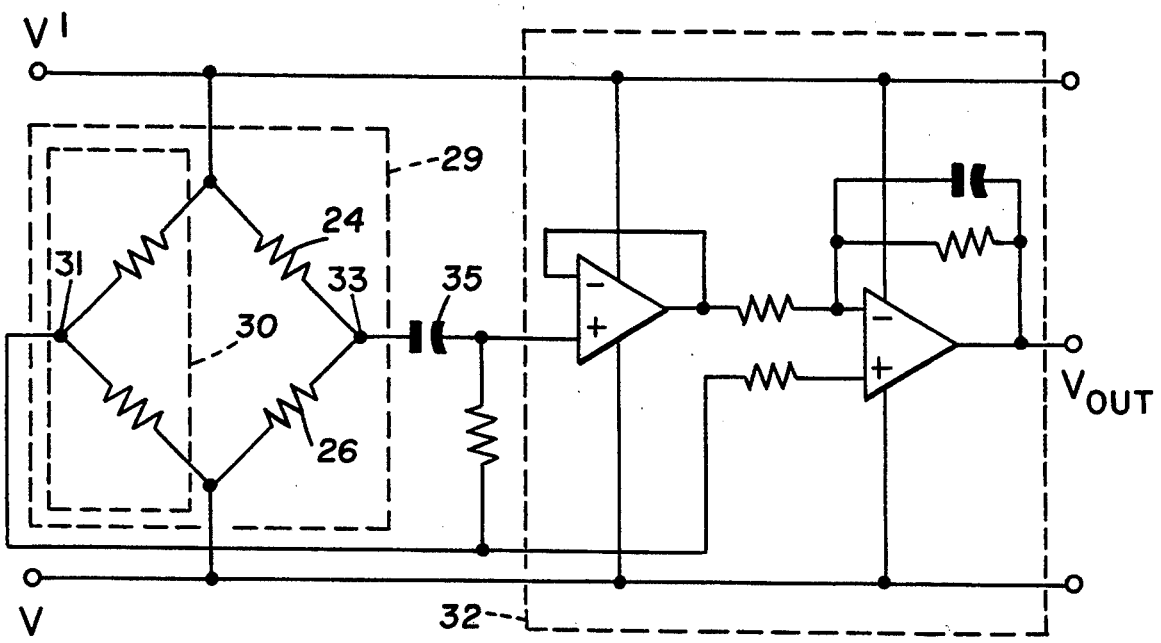
FIG. 2 illustrates details of circuity utilized in conjunction with the IR sensors illustrated generally in FIG. 1.

After the incident light 10 passes through filter 16 it impinges upon an ultraviolet sensor 22. After the incident light rays 12 and 14 pass through optical filters 18 and 20 respectively they impinge upon a pair of infrared sensors 24 and 26 respectively which are mounted upon a common heat sink 27 to reduce differential temperature effects. The heat-sinking surface incorporated in the present design is a thermoelectric cooler device, which is used to cool the IR sensor elements for better performance when the UV/IR detector operates at high ambient temperature. Signals generated by the UV sensor 22 are fed to an electronic non-linear amplifier 28 and then to an Analog to Digital Converter (ADC) 34 for signal conditioning. An ADC designated as Model number ADC-0808, available from Texas Instruments is suitable to perform this function. Signals generated by the IR sensors are in the form of variations in electrical resistance of the sensor elements, which together with a resistor network 30 (illustrated in FIG. 2) comprise a bridge circuit that feeds signals through an amplifier 32 and into the ADC 34. The output from the ADC 34 is fed to a digital processor 36, through a notch filter 38, a cluster 40 of weighted-moving-average filters and into a threshold comparator and circuit tester 42. The digital processor 36 may be taken from the 8051 industry standard microcontroller family. The output from the comparator/tester 42 is fed to a correlator circuit 44 then through a series of alarm decision making circuits 46 and finally into a series of alarm activation circuits 48. It will be noted that stored waveforms relating to profiles of fire characteristics may be fed to the correlator circuit 44 from a source 50. Additionally, data from predetermined external environmental measurements are fed to the alarm decision making circuits 46 from a source 52. Referring now to FIG. 2, the details of the circuitry of the IR sensors is illustrated. The first and second IR sensor elements 24 and 26 respectively are arranged as two legs of a resistive electrical bridge circuit which is illustrated as being within the area designated by numeral 29. The sensor elements 24 and 26 are lead selenide (PbSe) photoresistors that are sensitive to IR lightwaves. This circuitry provides high sensitivity to IR energy impinging on the sensors while maintaining immunity to variations in power supply voltage. The bridge circuit provides a mechanism for subtraction of blackbody radiation effects measured by both IR sensors from the composite measurement made by the first IR sensor which operates in the 4.3 to 4.5 micron range. This leaves carbon dioxide flame emissions, if present, as the primary residual signal. Output of the bridge circuit is taken from opposite corners 31, 33 of the bridge The bridge output is capacitively coupled by capacitor 35 to the following amplifier 32 to reduce effects of long-term variations from drifting of sensor resistances and environmental temperature changes.

As illustrated in FIG. 1, outputs of the UV and IR sensor analog conditioning circuits are supplied to a combination multiplexer and ADC converter 34, which produces digital data streams for digital signal processing of the sensor measurements. The data streams are stored temporarily in a buffer memory, which can be implemented as a discrete memory, such as a first in first out (FIFO) buffer device, or as memory locations in a digital processor. In the present invention the data is stored in a portion of the internal random-access memory 35 of the digital processor 36, with data from new samples overwriting data from the oldest samples when the new samples arrive.

The digital processing portion of the flame detector unit performs digital signal processing of sensor measurements, alarm decision-making, self-test, and equipment control functions.

The weighted-moving-average filters 40 as illustrated in FIG. 1, are used in the detector unit digital signal processing for establishment of threshold levels to discriminate against varying background radiation, for smoothing of sensed fire signals, and for rejection of spurious radiation from facility artificial lighting elements having periodicity synchronous with the 60 Hz alternating-current electrical power source.

Figure 3:
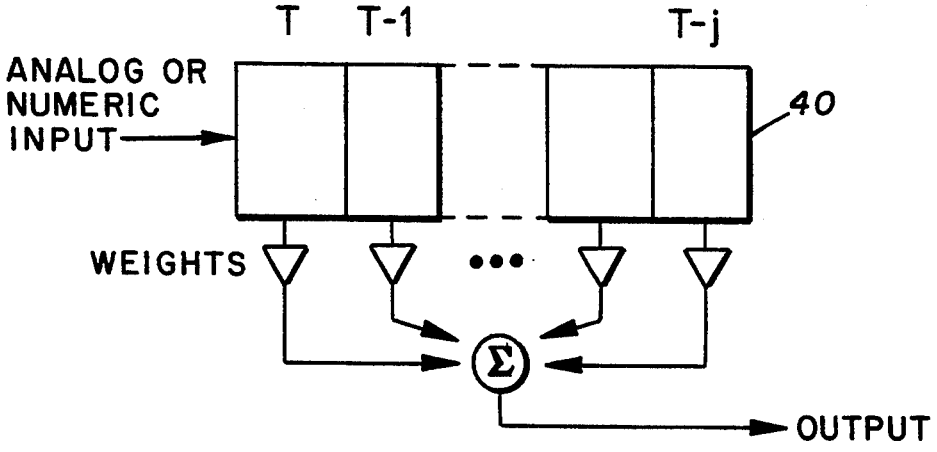
FIG. 3 is a functional block diagram of a weighted-moving-average filter configuration employed in the flame detector.

FIG. 3 is a functional block diagram of the weighted-moving-average filter configuration. In the flame detector, filters are designed for specific purposes by selection of the interval between samples, the number of samples incorporated in summation, and the values tapered for exponential, linear, and constant memory retention over finite numbers of samples. A constant memory weighting over a finite time interval in the sample sequence covered by the moving average tends to maintain good sensitivity in spite of gradual changes in background radiation conditions.

Separate tests are made in the flame detector digital signal processor comparing short-term signal strength averages to the long-term threshold levels for UV and IR sensor measurements respectively. The tests produce outputs that indicate UV and IR flame-detected conditions. The test results from UV and IR measurements are correlated to determine whether flame-detected conditions are indicated simultaneously by both sensor measurement/processing channels. The correlated results drive alarm decision making functions. Switch settings selected by the user permit selection of the margins by which signal levels must exceed background thresholds for flame indications to produce an output. A switch setting selection by the user permits UV measurements only to be considered.

Provisions are made in the system memory to store UV and IR profiles of fire signatures and false alarm source signatures that can be correlated with the sensor measurement processing channel outputs for use in alarm decision-making.

Relays are used for alarm activation.

Beginning with the notch filter 38, FIG. 1 illustrates the signal processing portion of the flame detector.

The following describes specific design aspects of the UV/IR flame detector implementation.

A detailed description of the functions of the more complex components of the flame detector, is as follows: sensor data acquisition, data filtering, threshold comparisons and alarm declarations, control and evaluation of the through-the-lens built-in self-test function and associated confidence output control. The following paragraphs describe each of these functions.

Sensor data acquisition is performed using timing logic to select the UV or IR analog sensor channel on the ADC converter 34 and to start the A-to-D conversion process. The end-of-conversion signal from the ADC 34 is input to the processor 36 through an interrupt pin. Upon interrupt, an ADC 8-bit data word is moved to internal memory 35 for later filtering. Four UV sensor samples are acquired at a rate of 480 samples per second and four IR sensor samples are acquired at a rate of 480 samples per second.

Data is filtered by first averaging the four UV samples in filter 38 to produce a UV sample average, and averaging the four IR samples to produce an IR sample average. The averaging process removes fluctuation effects of the flicker in artificial arc lighting (fluorescent, sodium, mercury, etc). The sample averages are compared by comparator 42 to the UV moving-average and the IR moving-averaging, which are maintained in moving-average filter cluster 40. Each of the moving averages utilizes eight sample averages which are stored in memory 40. The sample averages represent data taken at 7.5 second intervals over the most recent 60 seconds of operation.

Threshold comparisons are made by comparing the immediate UV and IR sample averages to the UV and IR moving averages, respectively. If both the UV and IR sample averages exceed the UV and IR moving averages by predefined threshold levels contained in alarm decision-making circuits 46, then an alarm is generated using logic output to energize the coil of the alarm relay and close its contacts.

Predefined threshold levels for comparison can be made in accordance with criteria of false alarm rate and/or sensitivity. Decision theory methods can determine predefined threshold levels under conditions of random signal and/or background variation with assumed statistical distributions. However, in typical applications of this invention, neither the flame variations nor the background variations are known to follow commonly studied statistical distributions. The predefined threshold levels of the immediate UV and IR sample averages in comparison to the UV and IR moving averages referred to herein are predefined through an empirical process of observing variations in background light levels and flame variations with time for expected operating environments.

Built-in self tests are performed at predefined intervals, usually on the order of minutes. The digital processor 36 acquires one UV sample and one IR sample, then illuminates a self-test lamp (not shown) and acquires one UV and one IR sample. If the "after" samples exceed the "before" samples by predefined threshold levels, then the test passes. After a predefined number of consecutive test failures (usually three) the self-test decision circuity 46 de-energizes the coil of a confidence relay (not shown) in the alarm activation circuitry 48 via a logic output. Under normal conditions the confidence relay coil is energized. Timing logic periodically (on the order of 0.1 seconds) provides pulses to a watchdog-timer capacitor whose decay voltage determines the confidence or trouble status.

Figure 4:
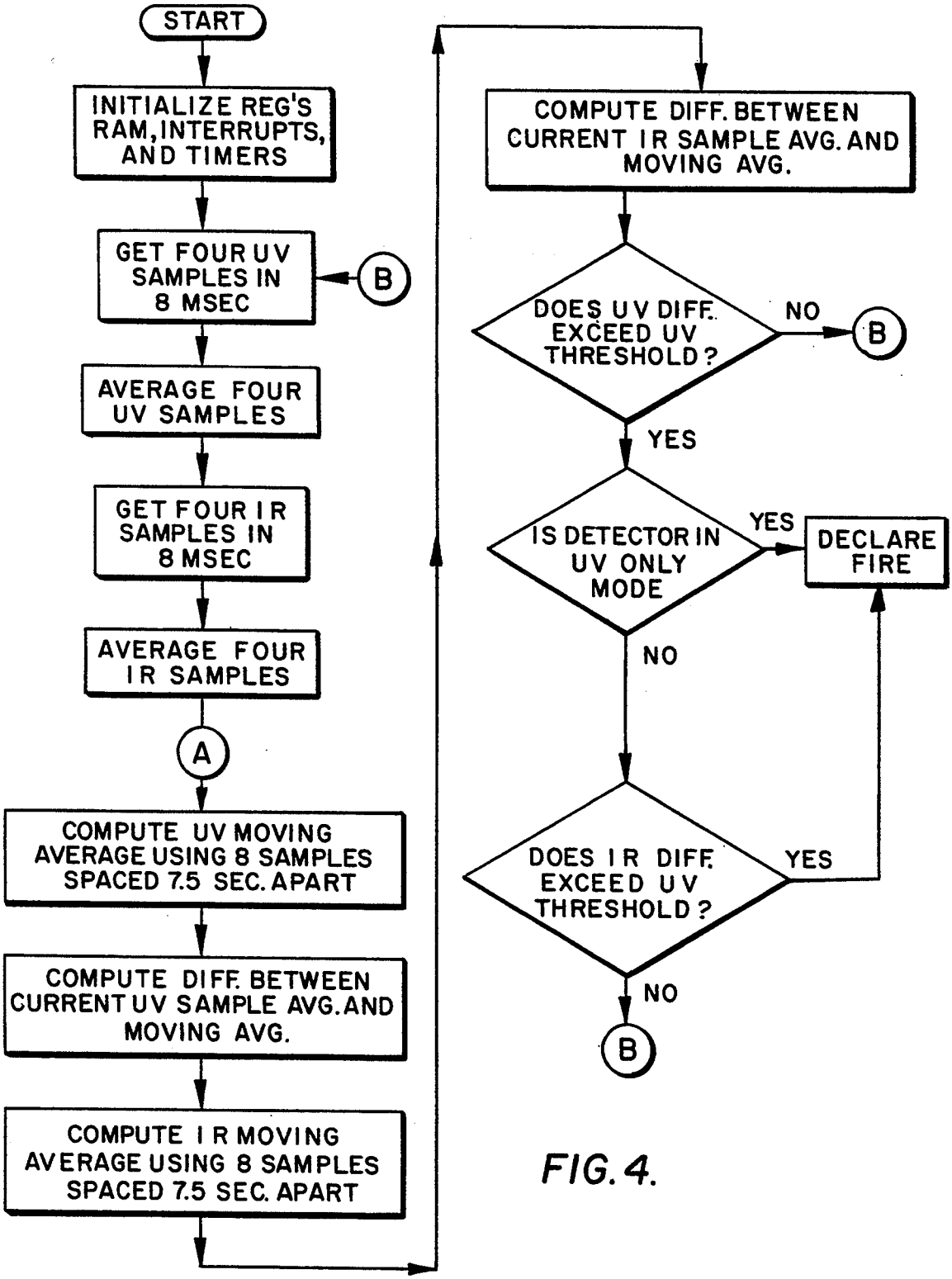
FIG. 4 is a functional flow diagram of the digital processing portion of the flame detector implementation.

FIG. 4 is a functional flow diagram of the digital processing portion of the flame detector implementation.

The digital processing program first initializes the data memory and data registers, and configures the hardware interrupts and timers. The program then acquires four UV sensor samples, each spaced 2 milliseconds apart in time. The four samples are averaged to remove variations caused by 120 Hz flicker resulting from artificial arc light radiation which is often present. Four IR sensor samples are similarly acquired and averaged. At 7.5 second intervals the program stores each of the UV and IR averages in data memory. A one minute moving average consists of eight such averages, each spaced 7.5 seconds apart. Each time new average samples are stored in data memory, the oldest average samples are overwritten, thereby maintaining memory of the most recent one minute of average samples. At approximately 16 milliseconds intervals, the program calculates the difference between the current UV and IR samples and the UV and IR moving averages, respectively. If both the UV difference and IR difference exceed a preset threshold, then a fire alarm signal is produced. If the program is configured for UV only mode, then the UV difference exceeding the UV moving average alone is sufficient for a fire alarm output signal. When no alarm is declared, the program resumes acquiring UV and IR sensor samples.

Obviously, numerous modifications and variations of the present invention are possible in light of the above teachings. It is therefore to be understood that within the scope of the appended claims the invention may be practiced otherwise than as specifically described herein.

I claim:

1. A flame detection system comprising:

an ultraviolet optical sensor, and first and second infrared optical sensors, each of said sensors being adapted for converting electromagnetic energy inputs to electrical outputs, each of said sensors having optical filter means for restricting passage of electromagnetic energy to predetermined wavelengths and amplifier means for amplifying the output thereof;

means connected to the amplifier means of said ultraviolet optical sensor for limiting the amplifier output in response to reception by said ultraviolet sensor of electromagnetic energy which exceeds a predetermined energy level;

an electrical bridge circuit means having a resistor as each of two legs thereof and having said first and said second infrared optical sensors respectively as the other legs thereof, said bridge circuit being adapted to receive an electrical input at the connections between each said resistor and infrared optical sensor and to provide output signals from connections made between each of said resistors and between each of said infrared optical sensors;

a following amplifier being capacitively coupled to the output of said electrical bridge circuit;

means connected to the outputs of said ultraviolet optical sensor and each of said infrared optical sensors for converting the analog signals therefrom to digital data streams;

means for processing said data streams;

means providing temporary storage of said data;

means within said processing means for establishing threshold levels to discriminate against predetermined types of signals;

means within said processing means for testing and comparing processed outputs from said ultraviolet and said infrared sensors so as to determine whether flame conditions are indicated;

means for producing an alarm signal in response to a determination by the processing means that flame conditions have been detected.

2. A flame detection system as set forth in claim 1 wherein said optical filter means is adapted to pass photons of wavelengths characteristic of hydrocarbon flames and to discriminate against photons of other wavelengths.

3. A flame detection system as set forth in claim 2 wherein said filter means of said ultraviolet optical sensor is adapted to pass only electromagnetic energy in the wavelength ranges of 250 nanometers to 310 nanometers and to reject electromagnetic energy of wavelengths longer than 330 nanometers.

4. A flame detection system as set forth in claim 2 wherein said filter means of said first infrared optical sensor is adapted to pass electromagnetic energy in the wavelength range of 4.3 microns to 4.5 microns.

5. A flame detection system as set forth in claim 2 wherein said filter means of said second infrared optical sensor is adapted to pass electromagnetic energy in the wavelength range of 3.3 microns to 3.5 microns.

6. A flame detection system as set forth in claim 1 wherein each of said optical filter means is of the absorptive type.

7. A flame detection system as set forth in claim 1 wherein each of said optical filter means is of the interference type.

8. A flame detection system as set forth in claim 1 wherein said means connected to the amplifier of said ultraviolet optical sensor for limiting the amplifier output in response to reception by said ultraviolet sensor of electromagnetic energy which exceeds a predetermined energy level is a nonlinear feedback network.

9. A flame detection system as set forth in claim 1 further comprising a thermoelectrically cooled heat sink and wherein reach of said first and second infrared optical sensors are mounted thereto.

10. A flame detection system as set forth in claim 1 wherein said processing means is provided with weighted-moving-average filters for establishment of threshold levels to discriminate against predetermined data input for smoothing of said data and for rejection of data signals having predetermined characteristics.

11. A flame detection system as set forth in claim 10 wherein said rejected data signals are resultant from the reception by said optical sensors of spurious radiation from artificial lighting elements having periods synchronous with 60 Hz alternating-current electrical power sources.

12. A flame detection system as set forth in claim 10 wherein said weighted-moving-average filters are adapted to provide a constant memory weighting over a finite time interval in the sample sequence covered by the moving average.

13. A flame detection system as set forth in claim 1 wherein said processor means is adapted to perform a comparison of short-term signal strength averages to long-term threshold levels for ultraviolet and infrared sensor measurements respectively and to provide results of said comparison, and wherein the results of said comparison alarm decision-making functions.

* * * * *